United States Patent [19]

Ostyn

[11] 4,103,897

[45] Aug. 1, 1978

[54] GOLFER'S STANCE CORRECTING DEVICE

[76] Inventor: Rene Ostyn, 810 S. 11th St., Fort Pierce, Fla. 33450

[21] Appl. No.: 810,320

[22] Filed: Jun. 27, 1977

[51] Int. Cl.[2] ..... A63B 69/36; A61F 3/00

[52] U.S. Cl. ..... 273/188 A; 128/80 H

[58] Field of Search ..... 273/188 R, 188 A, 189 R, 273/189 A, 183 B; 128/80 F, 80 H, 584, 585, 85, 166, 166.5

[56] References Cited

U.S. PATENT DOCUMENTS

| | | | |
|---|---|---|---|
| 1,336,001 | 4/1920 | Tranmer | 128/80 H |
| 1,469,315 | 10/1923 | Hansard | 273/189 A |
| 2,516,872 | 8/1950 | Hauser et al. | 128/80 H |
| 2,578,108 | 12/1951 | Thornton | 128/80 F |
| 3,423,094 | 1/1969 | Auslander et al. | 273/188 R X |
| 3,606,341 | 9/1971 | Honbarger | 273/188 R |
| 3,606,342 | 9/1971 | Albertson | 273/189 R |
| 3,614,107 | 10/1971 | Kinsey | 273/188 A |

*Primary Examiner*—George J. Marlo
*Attorney, Agent, or Firm*—Carroll F. Palmer

[57] ABSTRACT

A correcting device for a golfer's stance comprises a clamp portion which is fastened across the shank of a golfer's shoe, a flexible band for strapping about the lower leg of the golfer above the shoe carrying the clamp portion, a rigid strip member pivoted at its lower end to the clamp portion for fore and aft rocking movement and a pocket in the flexible band in which the upper end of the strip member is held. The device requires the golfer to maintain proper ankle posture during backswing and improves the golfer's club swing in hitting a golf ball.

5 Claims, 8 Drawing Figures

FIG 1A
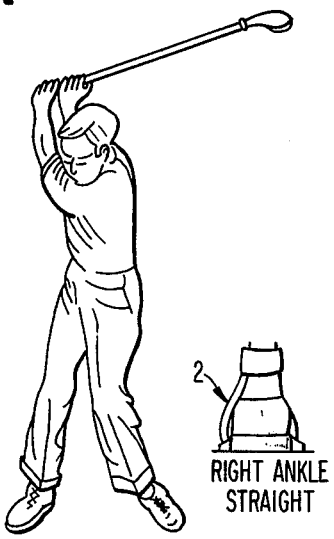
FIG 1B
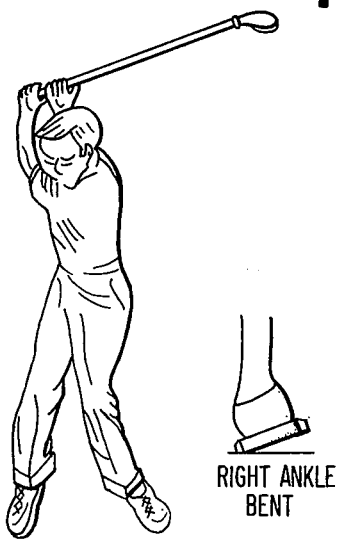
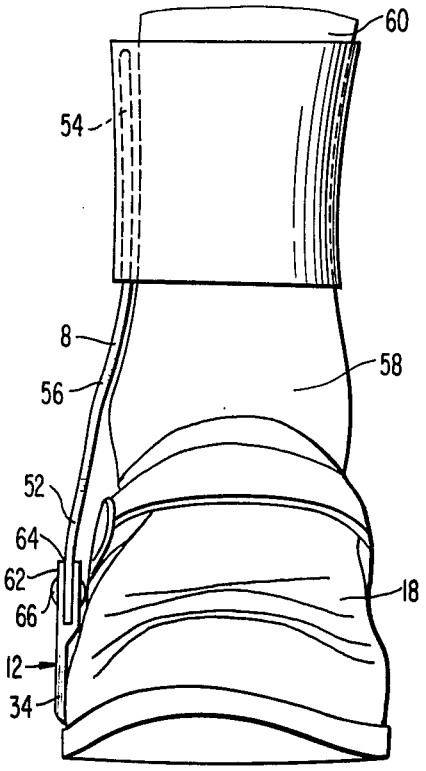
FIG 3
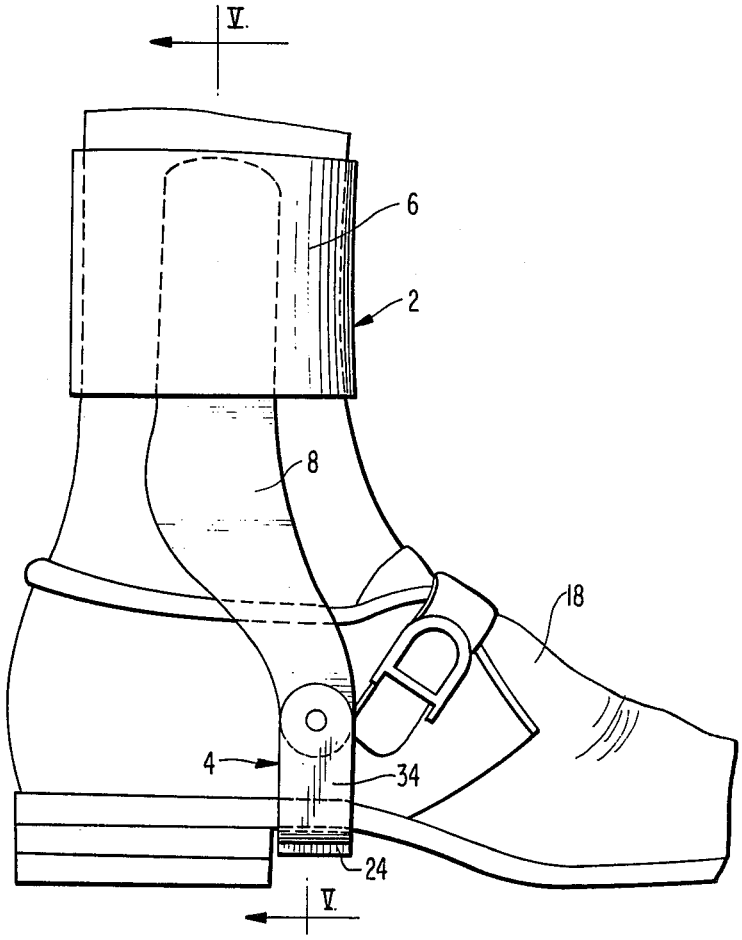
FIG 4

FIG 5
FIG 2
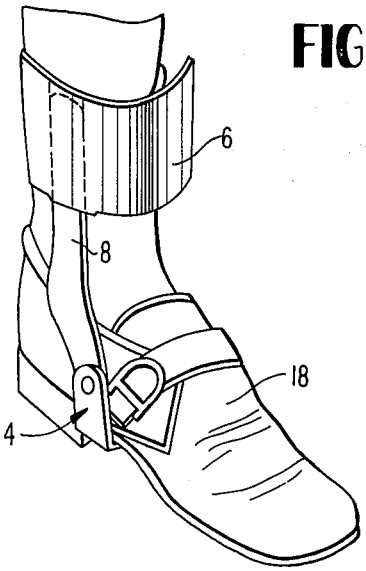
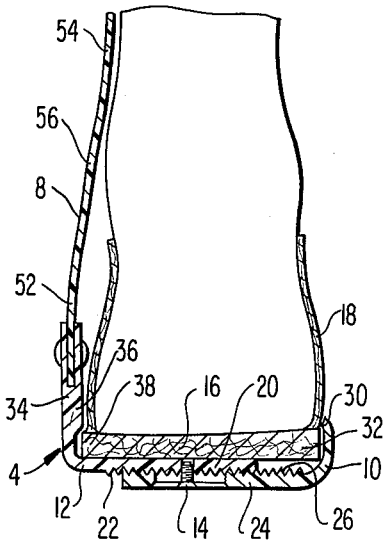
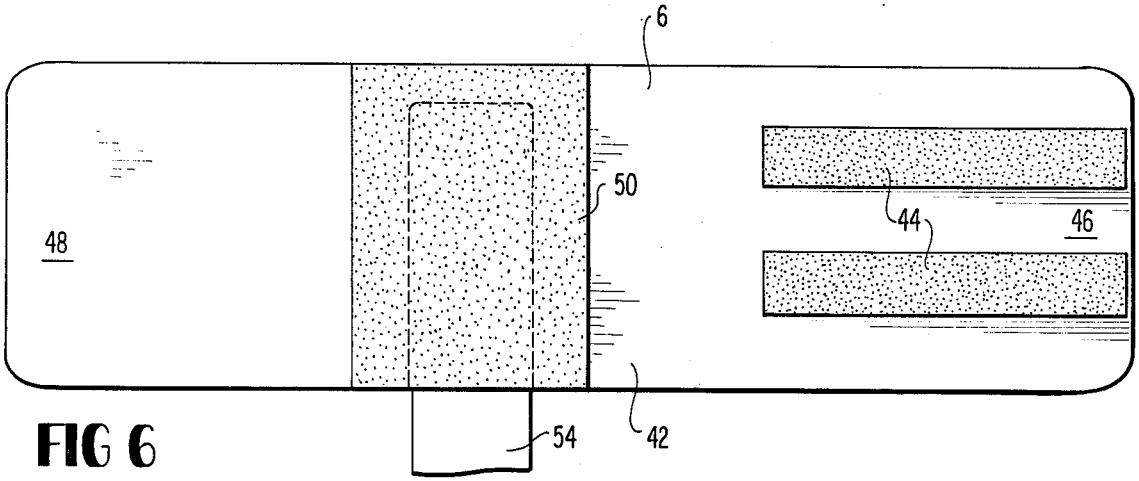
FIG 6
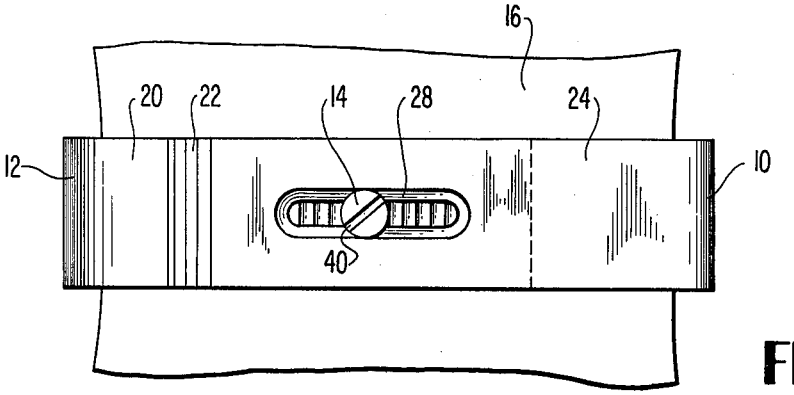
FIG 7

GOLFER'S STANCE CORRECTING DEVICE

BACKGROUND OF THE INVENTION

1. Field of the Invention

This invention relates to golfing equipment. More particularly, it concerns devices for correcting a golfer's stance and improving his golf swing.

2. Description of the Prior Art

In a properly performed golf swing, the golfer's body should not sway from side to side as the golfer's arms carry the golf club through the swing. A golfer with a faulty swing tends to sway and fails to shift his weight properly from one leg to the other in the act of hitting the ball so that the ball is "sliced" rather than being squarely hit.

A variety of devices have been suggested and developed for the purpose of mitigating the golfer's sway problem.

Such prior art devices require the positioning of spikes in the ground for their use. While they may be capable of improving the golfer's swing, the tedium of their use can be annoying to the golfer and his partners thereby detracting from the effective use of such devices.

Notwithstanding the large varieties of golf swing correctional devices that have been devised in the past, there is a need for a stance corrector that is of simple construction and is self-contained on the golfer's body so that its use does not require external items such as ground spikes, poles, standards or the like.

OBJECTS

A principal object of this invention is the provision of an improved type of golfer's stance correcting device.

A further object is the provision of new devices that mitigate golfer's body sway by firming the action of the golfer's back foot throughout the golf swing.

Another object is the provision of such new devices that do not require use of external items such as ground spikes, poles, standards or the like.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

These objects are accomplished according to the present invention by provision of a golfer's stance correcting device that basically comprises clamp means for fastening the device to the shank of the golfer's back foot shoe, a flexible band for strapping about the golfer's lower leg above the clamp means, a rigid strip member pivoted at its lower end to the clamp means for rocking movement parallel to the golfer's shoe and a pocket in the flexible band into which the upper end of the strip member extends so that it is held in position along the outside of the golfer's ankle.

The device as summarily described firmly restrains the golfer's ankle of his back foot so that it will not flex outwardly on the back swing. Since such ankle flexing is a major contributor to body sway during the golf swing, use of the new device of the invention mitigates body sway leading to improved golf swing and better performance by the golfer. The new correction device need only be applied to the golfer's back foot at the beginning of play and removed at the end. It does not cause any appreciable discomfort or hindrance to the golfer as he plays around the course and there is no tedium of use such as with devices requiring ground spikes or the like.

BRIEF DESCRIPTION OF THE DRAWINGS

A more detailed understanding of the golfer's stance correction devices of the invention and their method of use may be obtained by reference to the accompanying drawings in which:

FIG. 1A is a schematic view of a golfer using a stance correction device of the invention.

FIG. 1B is a schematic view of a golfer without such correction device showing how the golfer can bend the ankle of his back foot resulting in undesired body sway.

FIG. 2 is a perspective fragmentary view of the back foot and ankle of a golfer equipped with a stance correction device of the invention.

FIG. 3 is a front view of the golfer's ankle and foot corresponding to FIG. 2.

FIG. 4 is a side view corresponding to FIG. 2.

FIG. 5 is a fragmentary sectional view taken on the line V—V of FIG. 4.

FIG. 6 is a fragment plan view of the upper portion of the new correctional device with the flexible band in opened position.

FIG. 7 is an enlarged view of the clamp portion of the new correctional device clamped on the shank of a golfer's shoe.

DESCRIPTION OF THE PREFERRED EMBODIMENTS

The stance correction device 2 comprises clamp means 4, flexible band 6 and rigid strip member 8.

The clamp means 4 comprises a J-shaped member 10, an L-shaped member 12 and fastener element 14 to fix members 10 and 12 together in a U-shaped configuration of adjustable width for clamping across the shank 16 of the golfer's shoe 18. The leg portion 20 of member 12 is provided on its lower surface with serrations 22 and the leg portion 24 of member 10 has complementary serrations 26 in its upper surface to assist in holding the U-shaped configuration at an adjusted width. Such adjustment is by having the fastener element 14, e.g., a machine screw or equivalent element, extend through a longitudinal slot 28 in the leg portion 24 of member 10 and screw into the leg portion 20 of member 12.

As an alternative to the U-shaped configuration as just described, the members 10 and 12 can be reversed so that member 12 would be on the bottom and member 10 above. In such case, the top of leg portion 20 of member 12 and the bottom of leg portion 24 of member 10 would be serrated and the slot 28 would be in member 12.

The free-end 30 of member 10 is bent inwardly to form a gripper for the edge 32 of shoe shank 16. Also, the upstanding portion 34 of member 12 has a lug 36 that acts as a gripper for the edge 38 of shoe shank 16.

The clamp means 4 may be made of any suitable rigid material, e.g., metal, thermoplastic resin or thermosetting resin and may be formed by any suitable method, e.g., machining, casting, injection molding or the like. Preferably, members 10 and 12 are injection molded thermoplastics and fastener 14 is a machine metal screw with a slot 40 sized so that it will accept a small coin for turning.

The flexible band 6 is provided on its inner surface 42 with a pair of pressure-sensitive, non-adhesive fastener strips 44, e.g., "Velcro" strips, on the end portion 46. The opposite side of band 6 at end portion 48 carries a pair of complementary fastener strips.

In place of "Velcro", lacing, ties, snap fasteners, hooks and eyes or equivalent holding means may be used. A pocket 50 is provided on the inner face 42 of band 6. The band 6 may be, for example, formed of cloth, leather, artificial leather, flexible plastics and pocket 50 can be the same or different flexible material fastened to band 6 by stitching, fusion, adhesive or the like. The inner faces of the band 6 and pocket 50 may be padded with pile material, terry cloth or the like. A plurality of bands 6 of different colors may be provided to satisfy the desires of golfers to colormatch the device 2 with the golfer's apparel.

The rigid strip member 8 comprises a bottom end portion 52, a top end portion 54 and a central portion 56. The portion 52 may be narrower in width than portions 54 and 56 and portions 54 and 56 are bent inwardly relative to portion 52 to conform the strip 8 closely to the contour of the golfer's ankle 58 and lower leg portion 60.

The strip member 8 may be formed of metal, plastics or the like. Advantageously, it is formed by injection molding from the same plastics material as clamp members 10 and 12.

The upper end portion 54 of strip member 8 is held in the pocket 50.

The free-end 62 of member 12 has a slot 64 to receive and journal the lower end 52 of strip member 8. A rivet 66 or equivalent element holds the end 52 in the slot 64 so the strip member 8 may pivot on the member 12 in a rocking movement parallel to the golfer's shoe 18.

The use of the new stance correction devices of the invention is simple, but highly effective. At the beginning of play, the golfer clamps the device 2 upon his "back" foot, i.e., the right foot of a right-handed golfer. This is accomplished by loosening the screw 14, applying the clamp means 4 to the shank of the shoe for the back foot as shown in FIG. 5 and then tightening the screw 14. This may be done with the shoe on or off the golfer's foot. When the shoe is on the foot and the clamp means 4 fixed in place, the band 6 is wrapped around the lower leg portion 60 of the golfer and fastened by application of pressure to the "Velcro" strips with the upper end of member 8 in the band pocket 50 as shown in FIG. 2.

With the device 2 installed as described, the golfer can walk about the golf course unhindered. However, whenever he performs a golf swing, the device 2 will force him to maintain his ankle 58 unflexed as shown in FIG. 1A, avoiding a bent ankle as shown in FIG. 1B and the attendant body sway that results in a poorly executed golf swing.

The embodiments of the invention in which an exclusive property or privilege is claimed are defined as follows:

1. A golfer's stance correcting device comprising:

clamp means comprising a J-shaped rigid member, an L-shaped rigid member and a fastener element to fix said members together in a U-shaped configuration of adjustable width for clamping across the shank of a golfer's shoe, a flexible band for strapping about the lower leg of the golfer above the shoe carrying said clamp means, a rigid strip member having upper and lower ends pivoted at its lower end to the free end a said L-shaped member for rocking movement substantially parallel to the longitudinal axis as said golfer's shoe, and a pocket in said flexible band in which said upper end of said strip member is held.

2. The device of claim 1 wherein said J-shaped and L-shaped members have complementary serrations on their surfaces that contact each other in said U-shaped configuration to assist in holding said configuration at an adjusted width.

3. The device of claim 2 wherein the rigid member of said clamp means distal to the shoe shank has a longitudinal slot through which a screw carried by the other rigid member of the clamp means extends.

4. The device of claim 1 wherein said flexible band comprises pressure-sensitive, non-adhesive portions for use in strapping the band about the golfer's ankle.

5. The device of claim 1 wherein said free-end of said L-shaped member is slotted to form a journal for said lower end of said rigid strip member.

* * * * *